US009770903B2

(12) United States Patent
Takagi

(10) Patent No.: US 9,770,903 B2
(45) Date of Patent: Sep. 26, 2017

(54) LIQUID DISCHARGE COMPONENT AND LIQUID DISCHARGE APPARATUS

(71) Applicant: CANON KABUSHIKI KAISHA, Tokyo (JP)

(72) Inventor: Makoto Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/452,998

(22) Filed: Mar. 8, 2017

(65) Prior Publication Data

US 2017/0173944 A1 Jun. 22, 2017

Related U.S. Application Data

(63) Continuation of application No. 14/960,916, filed on Dec. 7, 2015, now Pat. No. 9,623,652.

(30) Foreign Application Priority Data

Dec. 16, 2014 (JP) ..... 2014-254550

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC ... B41J 2/04541; B41J 2/04586; B41J 2/0458
USPC ..... 347/9, 14
See application file for complete search history.

(56) References Cited

U.S. PATENT DOCUMENTS

| | | | | |
|---|---|---|---|---|
| 4,059,183 | A | 11/1977 | Hoskins | |
| 7,549,734 | B2 | 6/2009 | Imanaka et al. | |
| 8,721,047 | B2 | 5/2014 | Sakurai et al. | |
| 2002/0109739 | A1 | 8/2002 | Edelen et al. | |
| 2004/0183842 | A1 | 9/2004 | Kobayashi et al. | |
| 2006/0065812 | A1 | 3/2006 | Kitazawa | |
| 2012/0274703 | A1* | 11/2012 | Tsuchii | B41J 2/1404 347/40 |
| 2012/0306968 | A1* | 12/2012 | Benjamin | B41J 2/155 347/40 |

FOREIGN PATENT DOCUMENTS

| | | |
|---|---|---|
| JP | 2006-159893 A | 6/2006 |
| JP | 2010-179608 A | 8/2010 |

* cited by examiner

*Primary Examiner* — Huan Tran
*Assistant Examiner* — Alexander D Shenderov
(74) *Attorney, Agent, or Firm* — Fitzpatrick, Cella, Harper & Scinto

(57) ABSTRACT

A liquid discharge component includes discharge units arrayed to form columns each extending in a first direction and rows each extending in a second direction. Each discharge unit includes an element configured to apply energy to a liquid, and a driving circuit configured to drive the element. The component includes a logic circuit configured to control the driving circuit. The number of the columns is smaller than the number of the plurality of rows. The logic circuit includes shift registers configured to transfer, in the second direction, data to be supplied to the driving circuits. The shift register is configured to supply data to the discharge units of at least one row; the shift register includes flip-flops arranged in the second direction.

17 Claims, 11 Drawing Sheets

LIQUID DISCHARGE COMPONENT AND LIQUID DISCHARGE APPARATUS

BACKGROUND OF THE INVENTION

Field of the Invention

The present invention relates to a liquid discharge component and a liquid discharge apparatus.

Description of the Related Art

Japanese Patent Laid-Open No. 2006-159893 discloses a liquid discharge head such as a printhead that discharges ink. The liquid discharge head disclosed in Japanese Patent Laid-Open No. 2006-159893 includes a plurality of discharge orifices arrayed along an ink supply port extending in a predetermined direction, a plurality of recording elements corresponding to the respective discharge orifices, and a plurality of drivers that drive the respective recording elements. The liquid discharge head includes a processing block that supplies a signal to the plurality of drivers. In this arrangement, when the processing block is formed by shift registers that transfer data in a predetermined direction, the shift registers need to shift data by the number of times corresponding to the number of discharge orifices arrayed along the ink supply port. As a result, the shift operation consumes power corresponding to the number of discharge orifices arrayed along the ink supply port.

SUMMARY OF THE INVENTION

The present invention provides a liquid discharge component and liquid discharge apparatus having an arrangement advantageous for suppression of power consumption.

One of aspects of the present invention provides a liquid discharge component including a plurality of discharge units arrayed to form a plurality of columns each extending in a first direction and a plurality of rows each extending in a second direction, wherein each of the discharge units includes a discharge orifice, a liquid chamber communicating with the discharge orifice, an element configured to apply energy to a liquid in the liquid chamber, and a driving circuit configured to drive the element, the liquid discharge component comprises a logic circuit configured to control the driving circuits of the plurality of discharge units, the number of the plurality of columns is smaller than the number of the plurality of rows, the logic circuit includes a plurality of shift registers configured to transfer, in the second direction, data to be supplied to the driving circuits of the plurality of discharge units, each shift register is configured to supply data to the discharge units of at least one row, each shift register includes a plurality of flip-flops arranged in the second direction in correspondence with the plurality of columns and connected in series, and each of the plurality of flip-flops supplies data to the driving circuit of the discharge unit that is included in the at least one row corresponding to the shift register including the flip-flop, and included in a column corresponding to the flip-flop.

Further features of the present invention will become apparent from the following description of exemplary embodiments with reference to the attached drawings.

DESCRIPTION OF THE EMBODIMENTS

The present invention will now be described throughout exemplary embodiments by referring to the accompanying drawings. Note that an example in which a liquid discharge component according to the present invention is applied to an ink discharge component will be explained. However, the liquid discharge component according to the present invention is applicable to even an arrangement in which another liquid is discharged instead of ink. A solid may be mixed in the liquid. A liquid discharge apparatus in which the liquid discharge component is incorporated includes, for example, a controller that controls the liquid discharge component, and the controller supplies control data and the like to the liquid discharge component. The liquid discharge apparatus can be formed as a printer, or an apparatus that arranges liquid droplets.

Figure 1A:
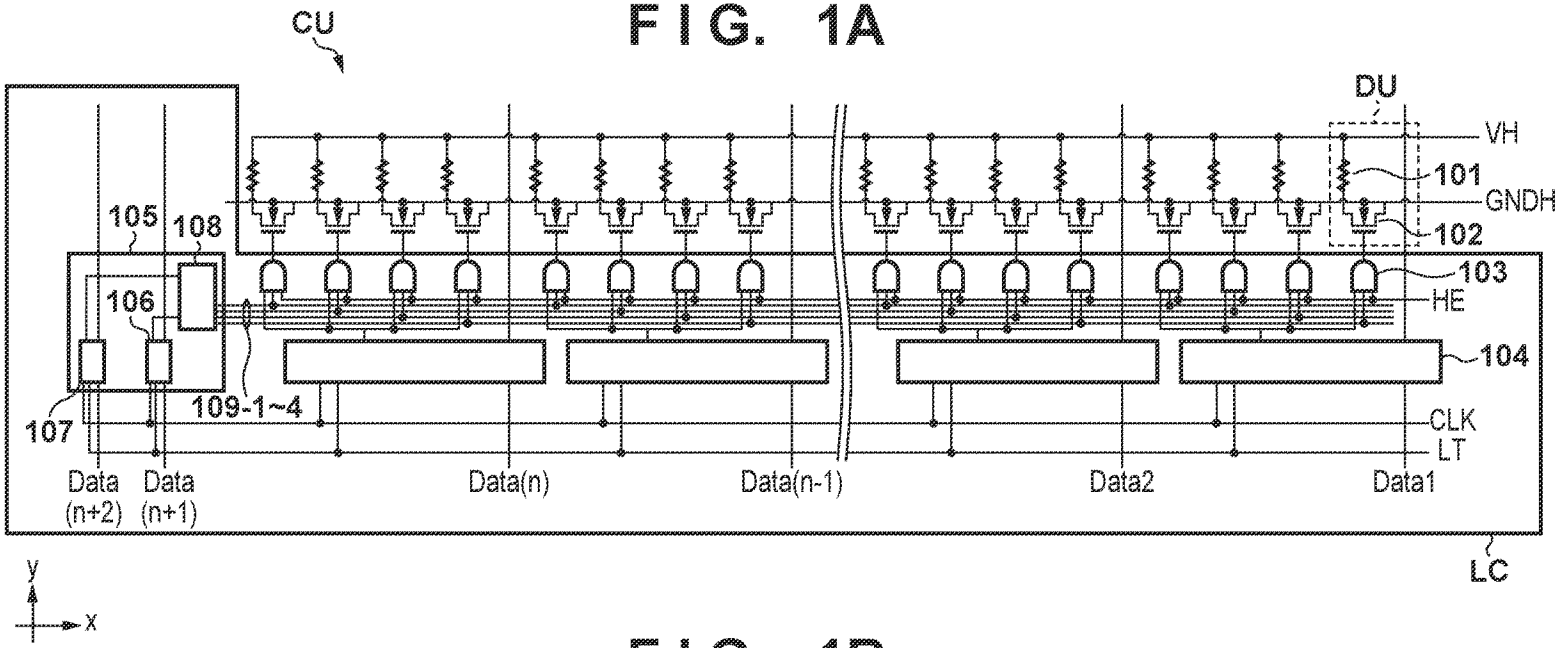
FIGS. 1A and 1B are views showing the arrangement of a column unit forming an ink discharge apparatus according to the first embodiment of the present invention.
Figure 2:
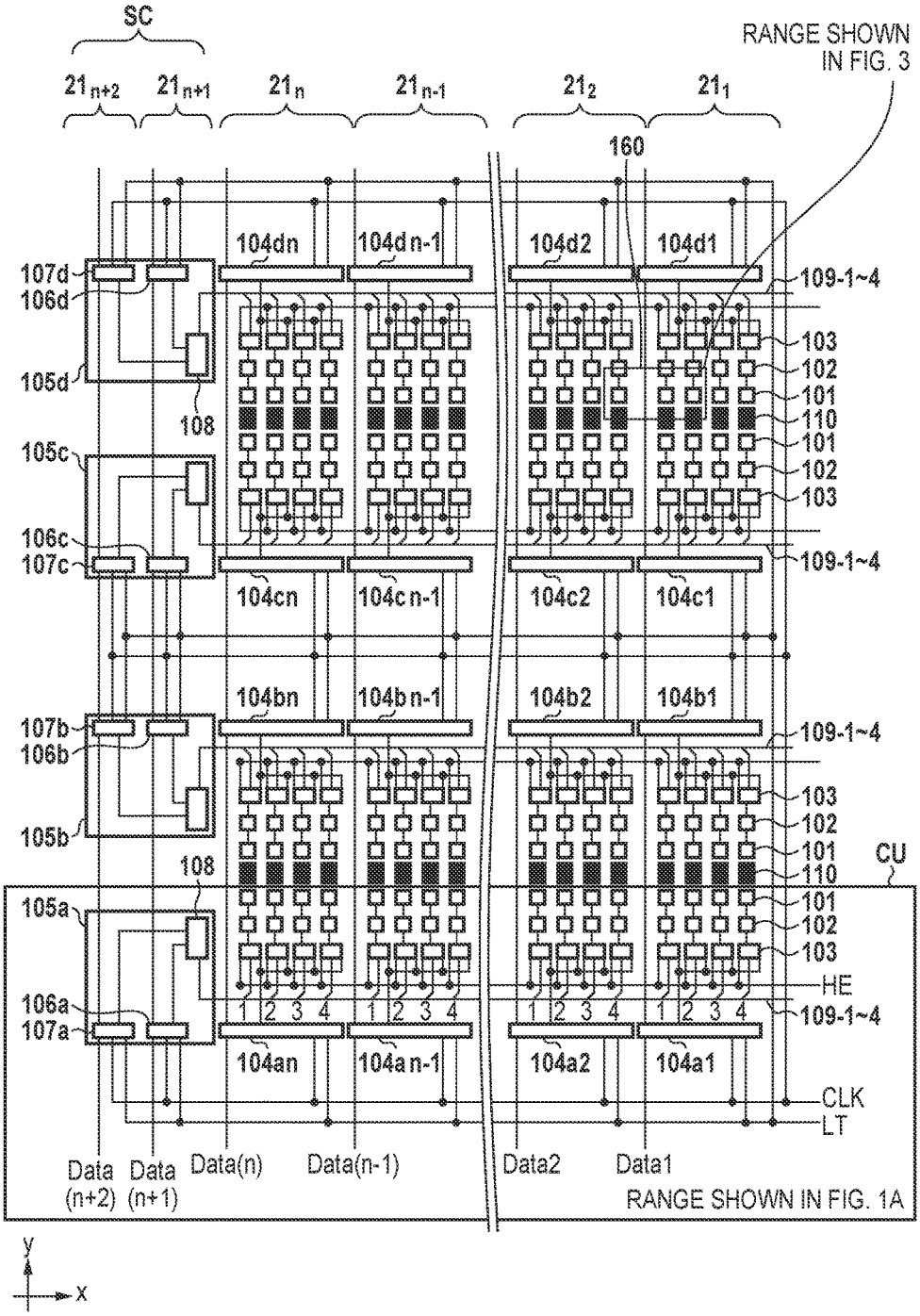
FIG. 2 is a circuit diagram showing the arrangement of the ink discharge apparatus according to the first embodiment of the present invention.
Figure 3A:
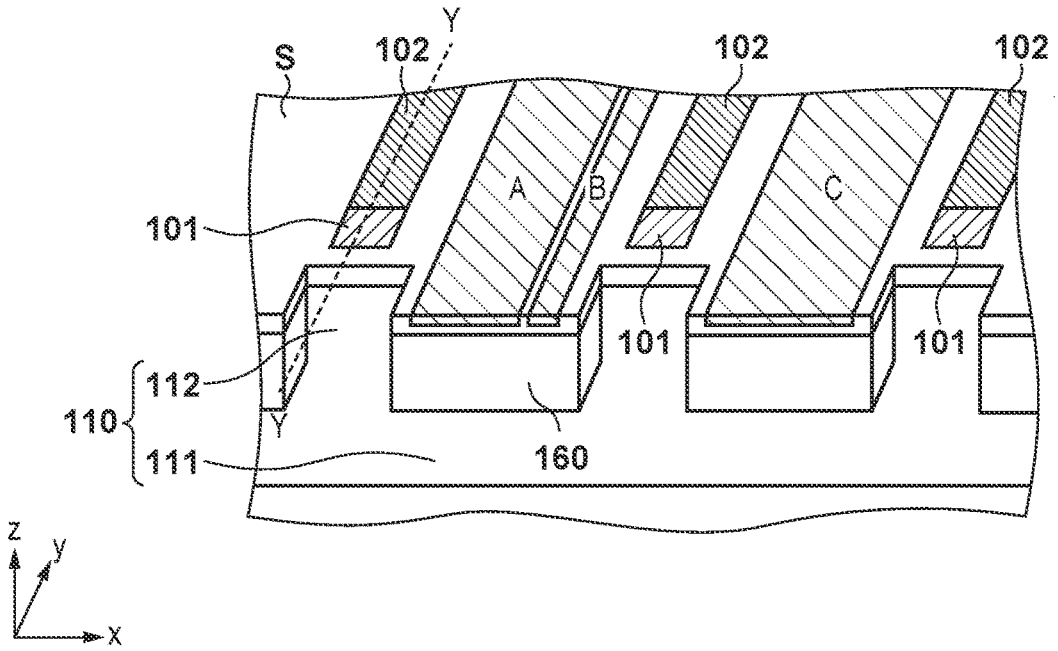
FIGS. 3A and 3B are views showing the partial arrangement of the ink discharge apparatus according to the first embodiment of the present invention.
Figure 3B:
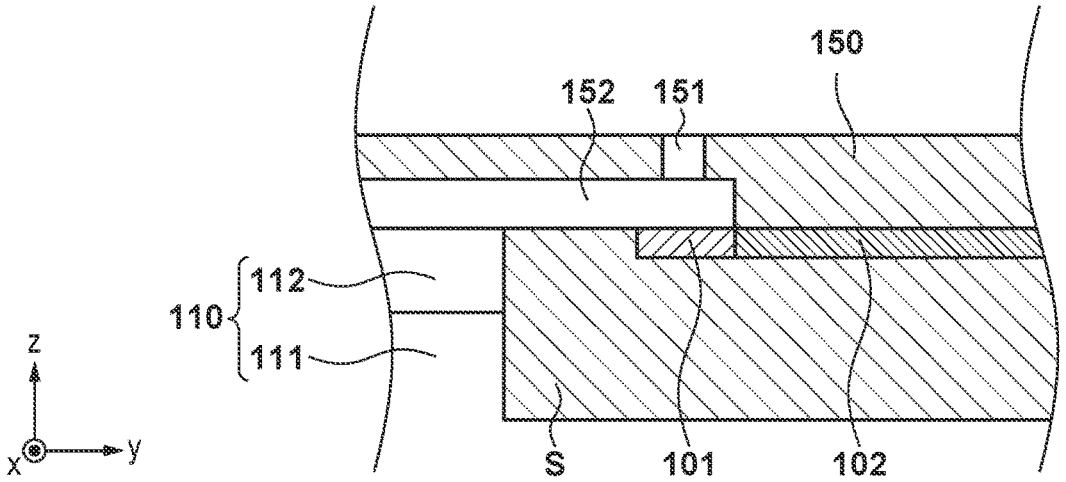

FIG. 1A shows the basic arrangement of an ink discharge component according to the first embodiment of the present invention, more specifically, a column unit CU that is a unit of one column. FIG. 2 shows the arrangement of an ink discharge component formed by a plurality of column units CU. The ink discharge component includes a plurality of discharge units DU arrayed to form a plurality of columns each extending parallel to the first direction (x direction) and a plurality of rows each extending parallel to the second direction (y direction). The column unit CU includes a predetermined number of discharge units DU arrayed in the first direction (x direction). As exemplified in FIGS. 3A and 3B, each discharge unit DU includes a discharge orifice 151, a liquid chamber 152 that communicates with the discharge orifice 151, an element (for example, heater) 101 that applies energy to a liquid (for example, ink) in the liquid chamber 152, and a driving circuit 102 that drives the element 101. The element 101 applies energy (for example, heat) to ink in the liquid chamber 152, discharging the ink from the discharge orifice 151. In addition, the column unit CU includes a logic circuit LC that controls the plurality of driving circuits 102. FIG. 3B is a sectional view taken along a line Y-Y in FIG. 3A. In FIG. 3A, an orifice plate 150 is not illustrated.

In the example shown in FIGS. 1A and 2, the plurality of discharge units DU are divided into a plurality of (n) blocks, and each block is formed by the discharge units DU of at least two rows (four rows in this example). Note that the plurality of discharge units DU may not be divided into blocks. The logic circuit LC can include a selection circuit SC that selects the discharge units DU of one of at least two rows forming each block, and a plurality of gate circuits (AND circuits in this example) 103. The selection circuit SC includes shift registers $\mathbf{21}_{n+1}$ and $\mathbf{21}_{n+2}$, and a plurality of decoders 108 corresponding to the respective columns.

The shift register $\mathbf{21}_{n+1}$ is formed by a plurality of shift register components 106*a* to 106*d*. Similarly, the shift register $\mathbf{21}_{n+2}$ is formed by a plurality of shift register components 107*a* to 107*d*. The suffix to 106, like 106*a* to 106*d*, is added to discriminate the shift register components 106 from each other. Also, the suffix to 107, like 107*a* to 107*d*, is added to discriminate the shift register components 107 from each other.

The shift register $\mathbf{21}_{n+1}$ is a shift register that shifts control data Data(n+1) in response to a clock signal CLK. The shift register $\mathbf{21}_{n+2}$ is a shift register that shifts control data Data(n+2) in response to the clock signal CLK. The decoder 108 decodes the control data Data(n+1) and Data(n+2) of 2 bits supplied from the shift register components 106 and 107, and activates one of selection signals 109-1 to 109-4. The shift register components 106 and 107 and the decoder 108 form a selection circuit 105 for one column. The suffix to 105, like 105*a* to 105*d*, is added to discriminate the selection circuits 105 from each other.

Each gate circuit (AND circuit) 103 supplies, to the corresponding driving circuit 102, the AND of two of the selection signals 109-1 to 109-4 supplied from the decoder 108, a signal from a corresponding block control circuit 104, and a heat timing signal HE. That is, each gate circuit 103 operates the driving circuit 102 designated by the control data Data(n+1) and Data(n+2) in accordance with data provided from the block control circuit 104. In this example, one block control circuit 104 is provided for four discharge units DU.

A first voltage VH (for example, 24 to 32 V) is supplied to one terminal of the element 101, and the drain of a high-voltage tolerant NMOS transistor forming the driving circuit 102 is connected to the other terminal of the element 101. A second voltage GNDH (for example, 0 V) is supplied to the source of the high-voltage tolerant NMOS transistor, and the output terminal of the gate circuit (AND circuit) 103 is connected to the gate of the high-voltage tolerant NMOS transistor.

Figure 1B:
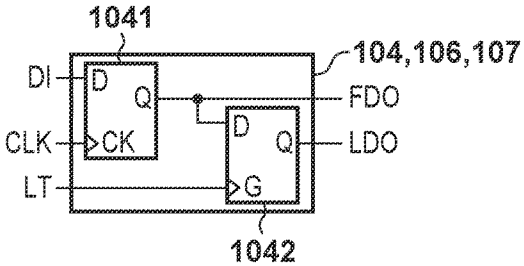

FIG. 1B shows an example of the arrangement of one block control circuit 104. The block control circuit 104 can be formed by, for example, one D flip-flop (example of a flip-flop) 1041 and one D latch 1042. In one example, the D flip-flop 1041 can be formed by an inverter circuit and an analog switch, and the D latch 1042 can also be formed by an inverter circuit and an analog switch. The D flip-flop 1041 has an input terminal D to which data DI is input, an input terminal CK to which the clock signal CLK is input, and an output terminal Q from which data FDO is output. The D latch 1042 has an input terminal D connected to the output terminal Q of the D flip-flop 1041, an output terminal Q from which latch data LDO is output, and an input terminal G to which a latch signal LT is input. Data output to the output terminal Q of the D flip-flop 1041 is output to the outside of the block control circuit 104, and also output to the input terminal D of the D latch 1042.

The ink discharge component includes first to nth shift registers $\mathbf{21}_1$ to $\mathbf{21}_n$. The first shift register $\mathbf{21}_1$ shifts data Data1 in response to the clock signal CLK. The second shift register $\mathbf{21}_2$ shifts data Data2 in response to the clock signal CLK. The nth shift register $\mathbf{21}_n$ shifts data Data(n) in response to the clock signal CLK. The first shift register $\mathbf{21}_1$ is formed by series-connecting the D flip-flops 1041 of respective block control circuits 104*a*1, 104*b*1, 104*c*1, and 104*d*1 by a signal line 1043. The second shift register $\mathbf{21}_2$ is formed by series-connecting the D flip-flops 1041 of respective block control circuits 104*a*2, 104*b*2, 104*c*2, and 104*d*2. The nth shift register $\mathbf{21}_n$ is formed by series-connecting the D flip-flops 1041 of respective block control circuits 104*an*, 104*bn*, 104*cn*, and 104*dn*. The suffix to 104, like the block control circuits 104*a*1, 104*b*1, 104*c*1, and 104*d*1, is added to discriminate the block control circuits 104 from each other. In this example, the number of the plurality of column units CU, that is, the number of the plurality of columns is four, and the number of stages of each of the first to nth shift registers $\mathbf{21}_1$ to $\mathbf{21}_n$ is four. In general, each of the first to nth shift registers $\mathbf{21}_1$ to $\mathbf{21}_n$ can be formed to supply data to the discharge units DU of at least one row forming one block. In the first embodiment, each of the first to nth shift registers $\mathbf{21}_1$ to $\mathbf{21}_n$ is formed to supply data to the discharge units DU of four rows forming one block.

Each of the first to nth shift registers $\mathbf{21}_1$ to $\mathbf{21}_n$ is also described as the ith shift register (i=1 to n). In the ith shift register (i=1 to n), data Data(i) is input to the input terminal D of the D flip-flop 1041 of the block control circuit 104*ai*, and received in response to the clock signal CLK supplied to the clock terminal CK. The ith shift register (i=1 to n) shifts the received data Data(i) sequentially through the block control circuits 104*bi*, 104*ci*, and 104*di* in response to the clock signal CLK. The D latches 1042 of the block control circuits 104*ai*, 104*bi*, 104*ci*, and 104*di* latch data to be output to the Q terminals of the D flip-flops 1041 connected to the input terminals D of the D latches 1042 in accordance with the latch signal LT input to the input terminals G.

The shift registers $\mathbf{21}_{n+1}$ and $\mathbf{21}_{n+2}$ can have the same arrangement as that of the first to nth shift registers. In other words, the shift register components 106, that is, 106*a* to 106*d*, and the shift register components 107, that is, 107*a* to 107*d*, can have the same arrangement as that of the block control circuit 104.

In the example shown in FIGS. 2, 3A, and 3B, two column units CU share one supply port 110 for supplying ink (liquid). However, in another example, only the column unit CU of one column may share one supply port 110. One supply port 110 includes a first portion 111 extending in the first direction (x direction), and a plurality of second portions 112 that make the first portion 111 communicate with the plurality of liquid chambers 152. Beams 160 are provided between the second portions 112 adjacent to each other among the plurality of second portions 112. The direction in which the first portion 111 of the supply port 110 extends, that is, the first direction (x direction) is a direction in which a column formed by the discharge units DU extends, and a direction in which the plurality of beams 160 are arrayed. The number of the plurality of columns is smaller than the number of the plurality of rows. The number of the plurality of columns can be smaller than the sum of the number of first to nth shift registers and the number of shift registers $\mathbf{21}_{n+1}$ and $\mathbf{21}_{n+2}$ included in the selection circuit SC.

As exemplified in FIGS. 3A and 3B, the supply port 110, the liquid chambers 152, the elements 101, the driving circuits 102, and the like are provided on a substrate S such as a silicon substrate. The orifice plate 150 is provided on the substrate S to define the liquid chambers 152 and the supply port 110. The discharge orifices 151 are provided in the orifice plate 150. A plurality of wiring patterns A, B, and C extending in the second direction (y direction) through the beams 160 are provided. In one example, the wiring patterns A and C are GNDH lines, and the wiring pattern B forms the signal line 1043 that connects the D flip-flops 1041 in each of the first to nth shift registers and the shift registers $\mathbf{21}_{n+1}$ and $\mathbf{21}_{n+2}$. That is, the first to nth shift registers and the shift registers $\mathbf{21}_{n+1}$ and $\mathbf{21}_{n+2}$ transfer data through the wiring patterns B provided on the beams 160.

Figure 11:
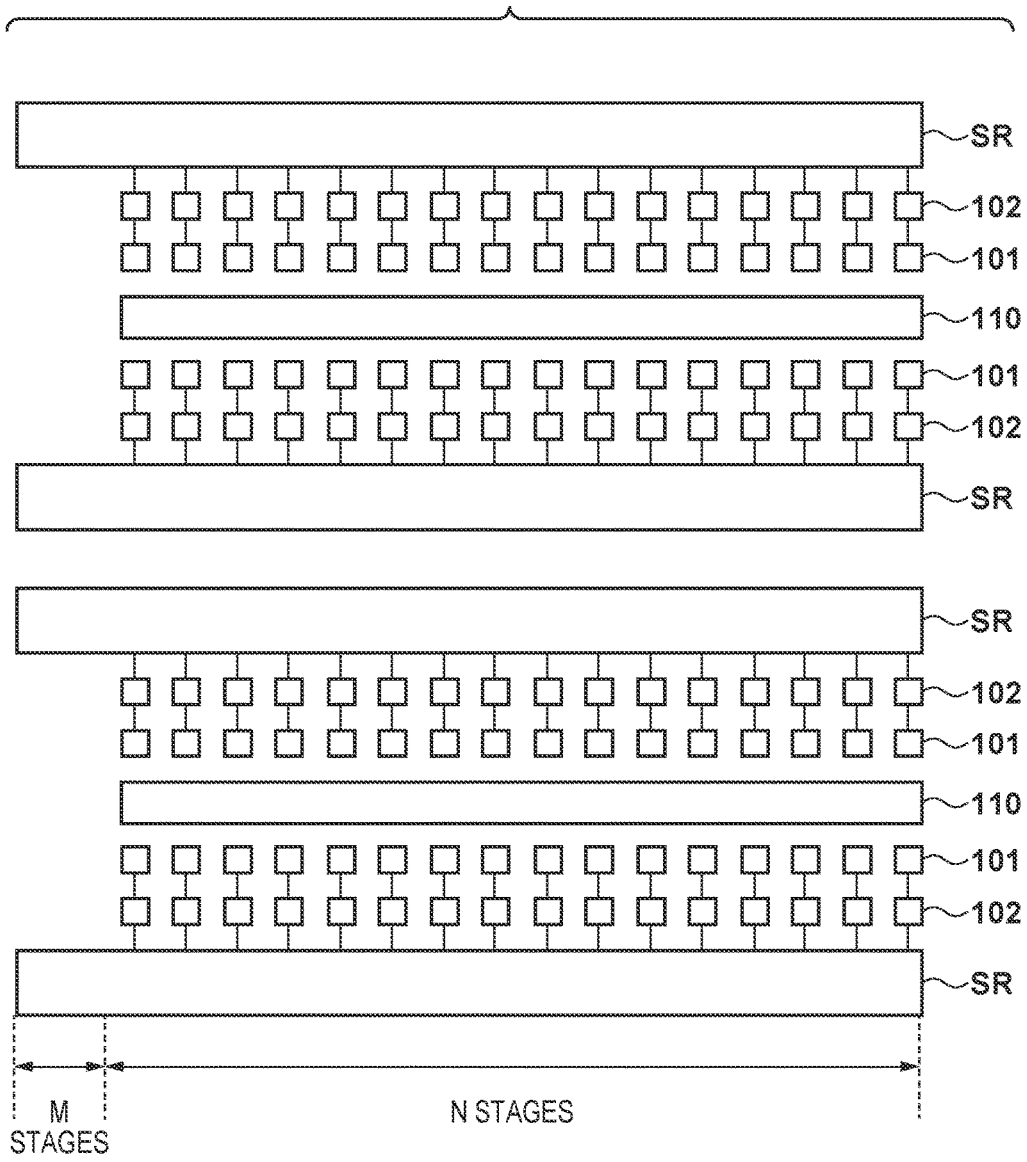
FIG. 11 is a view showing a comparative example.

FIG. 11 shows a comparative example in which the supply ports 110 extend in the first direction (x direction) and do not have any beam. In the comparative example, each shift register SR is formed by connecting D flip-flops in the first direction in which the supply port 110 extends. The shift register SR shifts data in the first direction. In the comparative example, letting N be the number of blocks in one column, and M be the number of bits of data to be supplied to the decoder 108, each shift register SR requires D flip-flops of (N+M) stages in order to supply data to the driving circuits 102 and the decoder 108. Therefore, the number of leading edges (or trailing edges) (clocks) of the clock signal CLK necessary to set data in all the D flip-flops is (N+M).

To the contrary, in the first embodiment, the number of stages of each of the first to nth shift registers $\mathbf{21}_1$ to $\mathbf{21}_n$ and the shift registers $\mathbf{21}_{n+1}$ and $\mathbf{21}_{n+2}$ is equal to the number L of (four in FIG. 2) column units CU. In the first embodiment, letting N be the number of blocks, and M be the number of bits of data to be supplied to the decoder 108, N+M>L is preferable in terms of decreasing the number of stages of each shift register. Here, decreasing the number of stages of the D flip-flops forming each shift register means speeding up setting of data in each shift register.

Figure 4:
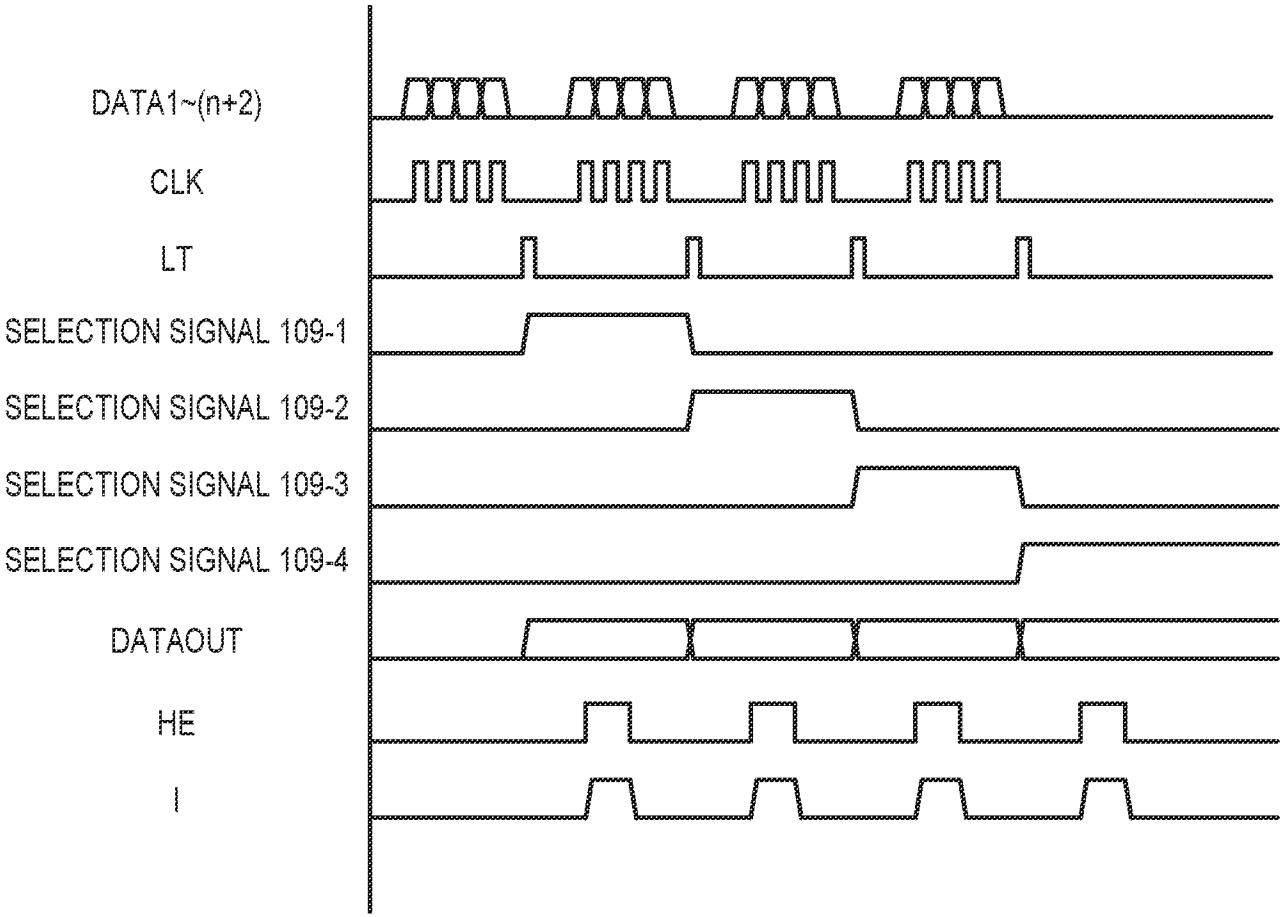
FIG. 4 is a timing chart showing the operation of the ink discharge apparatus according to the first embodiment of the present invention.

FIG. 4 is a timing chart showing the operation of the ink discharge component according to the first embodiment. In this case, N=4. In FIG. 4, all the discharge units DU are selected once. Control data Data1 to Data(n+2) are generated in accordance with an image to be formed. Data1 to Data (n) are image data corresponding to an image to be formed, and Data(n+1) and Data(n+2) are data for selecting the discharge unit DU in a block.

First, Data1 to Data(n+2) are successively supplied to the shift registers $\mathbf{21}_1$ to $\mathbf{21}_{n+2}$ in synchronism with the clock signal CLK, and latched by the D latches 1042 in the block control circuits 104 and the shift register components 106 and 107 of the selection circuits 105 in accordance with the latch signal LT. This means that target data are written in all the D latches 1042. DATAOUT represents data that is latched by the D latch 1042 and output. Each decoder 108 activates one of the selection signals 109-1 to 109-4 in accordance with the latched Data(n+1) and Data(n+2), and selects one discharge unit DU in the block. When the image data is at active level (high level in this example), the gate circuit 103 in the selected discharge unit DU changes to a heat standby state, and supplies a current I to the element 101 in response to the heat timing signal HE. This operation is repeated while changing the discharge unit DU to be selected in the block.

Next, the power consumption in the ink discharge component will be explained. In the ink discharge component, the state of the D latch 1042 in the block control circuit 104 and the states of the D latches 1042 in the shift register components 106 and 107 of the selection circuit 105 are updated in every discharge period. Thus, the shift operation is necessary by the number of stages of the shift registers in every discharge period. That is, the total number of times of driving of the D flip-flops 1041 in the shift registers $\mathbf{21}_1$ to $\mathbf{21}_{n+2}$ in every discharge period is given by the number of D flip-flops x the number of clocks x the number of shift registers. Note that the number of D flip-flops is the number of D flip-flops 1041 forming one shift register, and the number of clocks is the number of clock signals CLK supplied to the D flip-flops 1041 in order to shift data up to the final stage of the shift register. The number of shift registers is the number of first to nth shift registers $\mathbf{21}_1$ to $\mathbf{21}_n$ and shift registers $\mathbf{21}_{n+1}$ and $\mathbf{21}_{n+2}$ in the first embodiment, and is the number of shift registers SR in the comparative example.

In the D flip-flop 1041, the analog switch is driven based on the logic of the clock signal CLK, and the internal logic is updated in every driving, consuming power. On condition that the discharge period is constant, the power consumption of the D flip-flops 1041 in the first to nth shift registers and the shift registers $\mathbf{21}_{n+1}$ and $\mathbf{21}_{n+2}$ is proportional to the total number of times of driving of the D flip-flops 1041.

The first embodiment and the above-mentioned comparative example will be compared for L=4, M=2, and N=4. In the first embodiment, the number of D flip-flops 1041 forming each shift register is four, the number of clocks is four, the number of shift registers is six, and thus the total number of times of driving is 96 (=4×4×6). In contrast, in the comparative example, the number of D flip-flops is six, the number of clocks is six, the number of shift registers is four, and the total number of times of driving is 144 (=6×6×4). Hence, the power consumption becomes smaller in the first embodiment than in the comparative example. This applies to even a case in which block division is not performed.

In a concrete example of the first embodiment, the shift register is formed by connecting the four D flip-flops 1041 arranged in the second direction (y direction) by the signal line 1043 formed from the wiring pattern B provided on the beam 160. However, in another example, one shift register may be formed by a total of eight D flip-flops by coupling two shift registers adjacent to each other in the first direction (x direction). This arrangement is effective particularly when the number of D flip-flops does not exceed the number of (N+2 in the first embodiment) D flip-flops of one column unit CU.

As described throughout the concrete example in the first embodiment, the number of clocks necessary to set data in all the D latches can be minimized by setting the same number of D flip-flops in all the shift registers.

Although all the shift registers are formed by the same number of stages in the first embodiment, the present invention is not limited to this. When the total number of flip-flops cannot be divided by the number of shift registers $\mathbf{21}_1$ to $\mathbf{21}_{n+2}$, the flip-flops are preferably formed as follows. That is, the flip-flops are formed so that a number obtained by subtracting the average value of the number of flip-flops included in the shift registers $\mathbf{21}_1$ to $\mathbf{21}_{n+2}$ from the maximum value of the number of flip-flops included in the shift registers $\mathbf{21}_1$ to $\mathbf{21}_{n+2}$ becomes smaller than 1. Data can therefore be set in all the latches by the smallest number of clocks. Alternatively, when the total number of flip-flops cannot be divided by the number of shift registers $\mathbf{21}_1$ to $\mathbf{21}_n$, the flip-flops are preferably formed as follows. That is, the flip-flops are formed so that a number obtained by subtracting the average value of the number of flip-flops included in the shift registers $21_1$ to $21_n$ from the maximum value of the number of flip-flops included in the shift registers $21_1$ to $21_n$ becomes smaller than 1. If the flip-flops are formed so that the maximum value of the number of flip-flops included in the shift registers $21_1$ to $21_n$ becomes smaller than M+N, this yields a power consumption reduction effect, compared to the comparative example.

Figure 5:
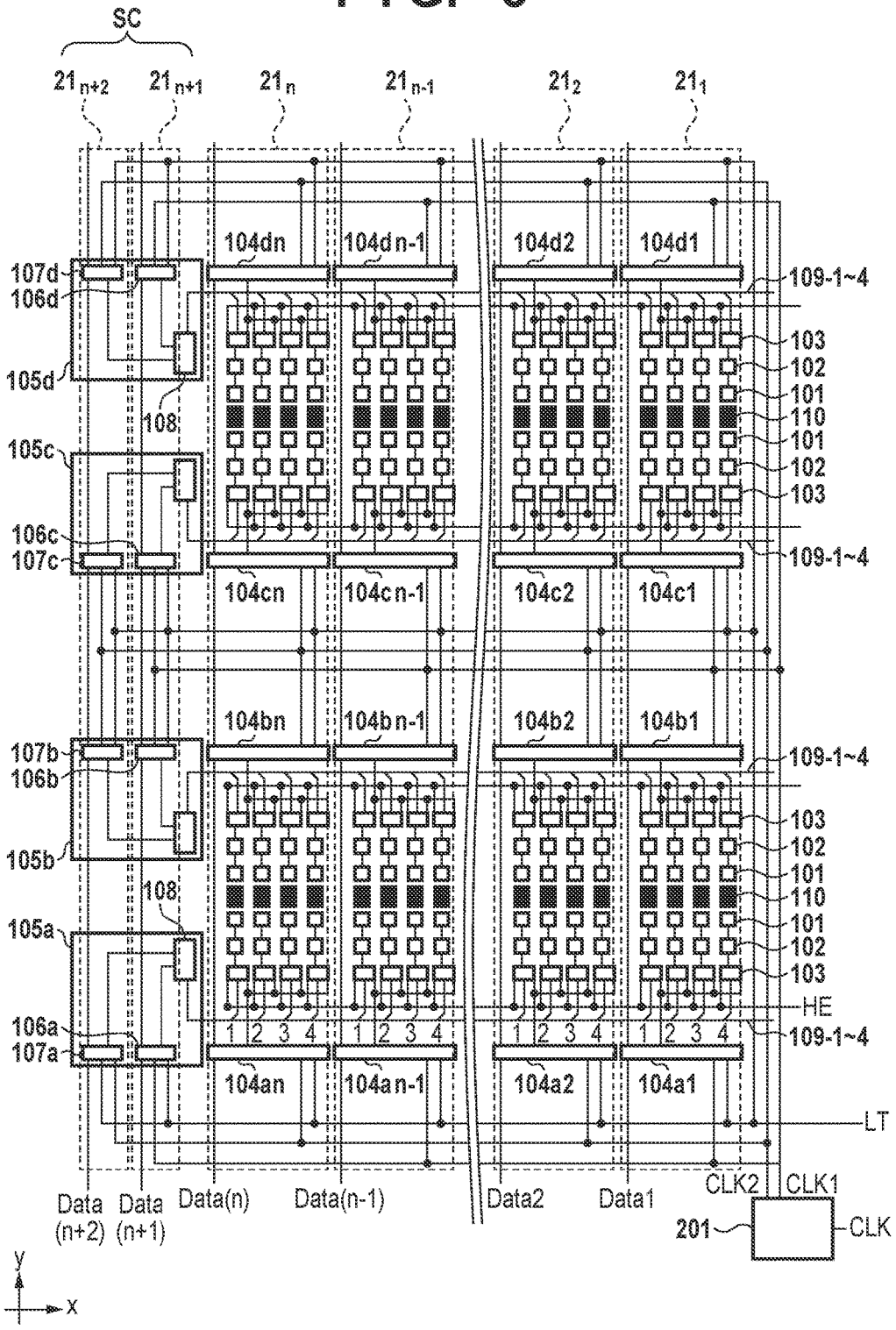
FIG. 5 is a circuit diagram showing the arrangement of an ink discharge apparatus according to the second embodiment of the present invention.

FIG. 5 shows an ink discharge component according to the second embodiment of the present invention. The second embodiment is different from the first embodiment in that shift registers are divided into two groups, a first clock signal CLK1 is supplied to one of the two groups, and a second clock signal CLK2 is supplied to the other group. Matters not particularly mentioned in the second embodiment can comply with the first embodiment. The ink discharge component according to the second embodiment includes a clock generator 201 that generates the first clock signal CLK1 and the second clock signal CLK2.

Each of first to nth shift registers $21_1$ to $21_n$ and shift registers $21_{n+1}$ and $21_{n+2}$ is also described as the ith shift register (i=1 to n+2). The shift registers $21_1$ to $21_{n+2}$ can be divided into the first group formed from shift registers each having an odd i, and the second group formed from shift registers each having an even i. Shift registers each having an odd i are odd-numbered shift registers in the array of the shift registers $21_1$ to $21_{n+2}$, and shift registers each having an even i are even-numbered shift registers in the array of the shift registers $21_1$ to $21_{n+2}$.

Figure 6:
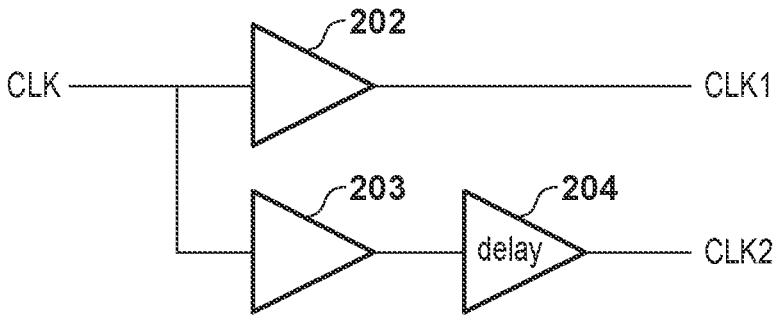
FIG. 6 is a circuit diagram showing an example of the arrangement of a clock generation circuit.

The first clock signal CLK1 is supplied to the shift registers of the first group, and the second clock signal CLK2 is supplied to the shift registers of the second group. FIG. 6 shows an example of the arrangement of the clock generator 201 that generates the first clock signal CLK1 and the second clock signal CLK2. The clock generator 201 includes, for example, buffers 202 and 203 and a delay circuit 204. A clock signal CLK is supplied to the buffers 202 and 203. The buffer 202 buffers the clock signal CLK and generates the first clock signal CLK1. The buffer 203 buffers the clock signal CLK and supplies it to the delay circuit 204. The delay circuit 204 gives a delay Δt to the input clock signal CLK and generates the second clock signal CLK2. The time difference Δt is generated between CLK1 and CLK2. Note that the first clock signal CLK1 and the second clock signal CLK2 can be generated by various arrangements.

The peak of the power consumption can be lowered by dividing the shift registers $21_1$ to $21_{n+2}$ into a plurality of (arbitrary number of two or more) groups, as described above, and operating the plurality of groups in different periods. In this case, group division may be performed for the shift registers $21_1$ to $21_n$.

Figure 7:
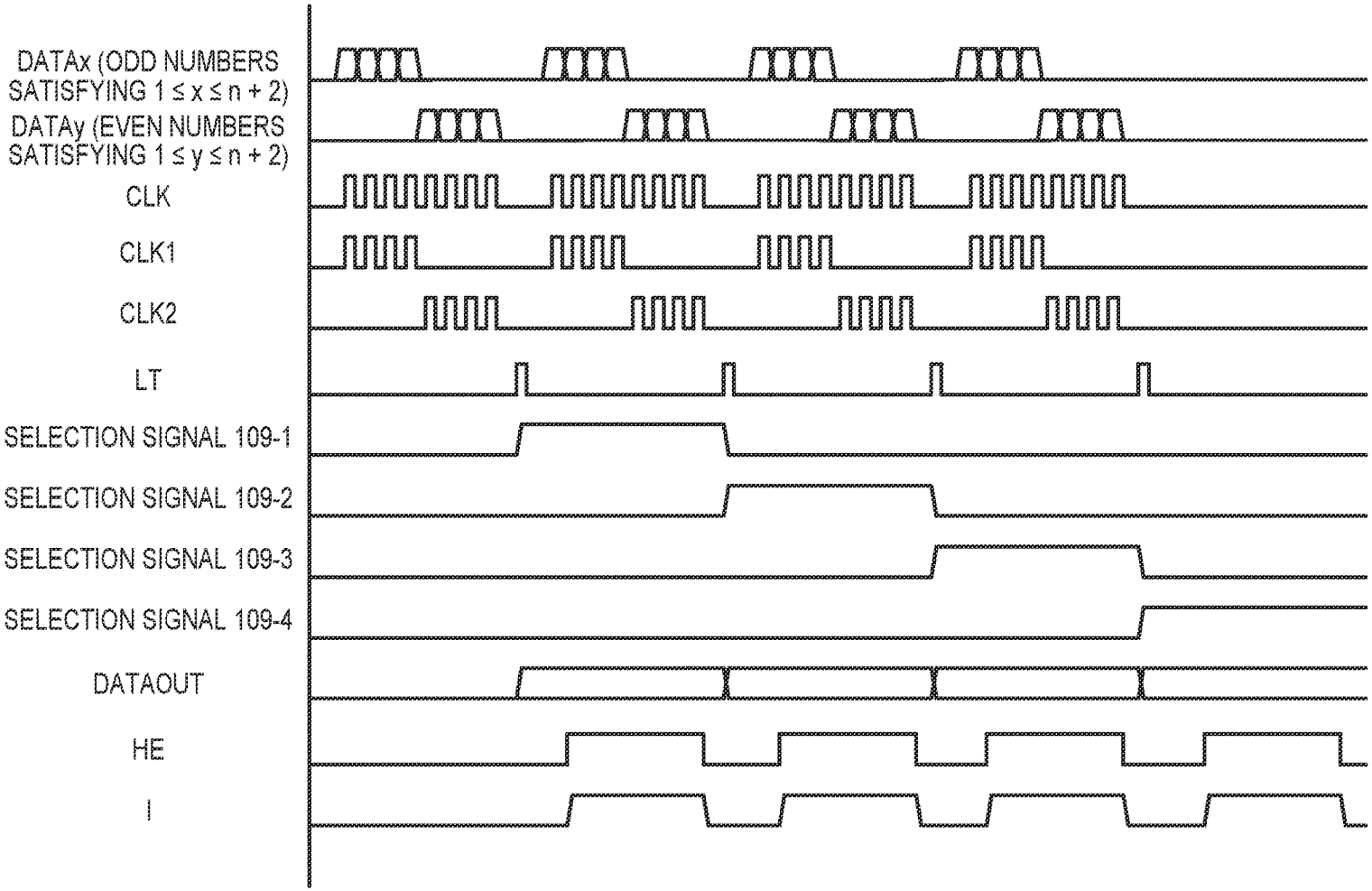
FIG. 7 is a timing chart showing the operation of the ink discharge apparatus according to the second embodiment of the present invention.

FIG. 7 shows an operation according to a modification of the second embodiment. In this modification, the first clock signal CLK1 and the second clock signal CLK2 are generated by partially masking the clock signal CLK. In another modification, the first clock signal CLK1 and the second clock signal CLK2 may be supplied from the outside. In still another modification, division into a plurality of groups is not limited to the group of odd-numbered shift registers and the group of even-numbered shift registers, and for example, a predetermined number of neighboring shift registers may be classified into one group. It is effective in lowering the peak of power consumption that the numbers of shift registers forming respective groups are equal to each other.

Figure 8:
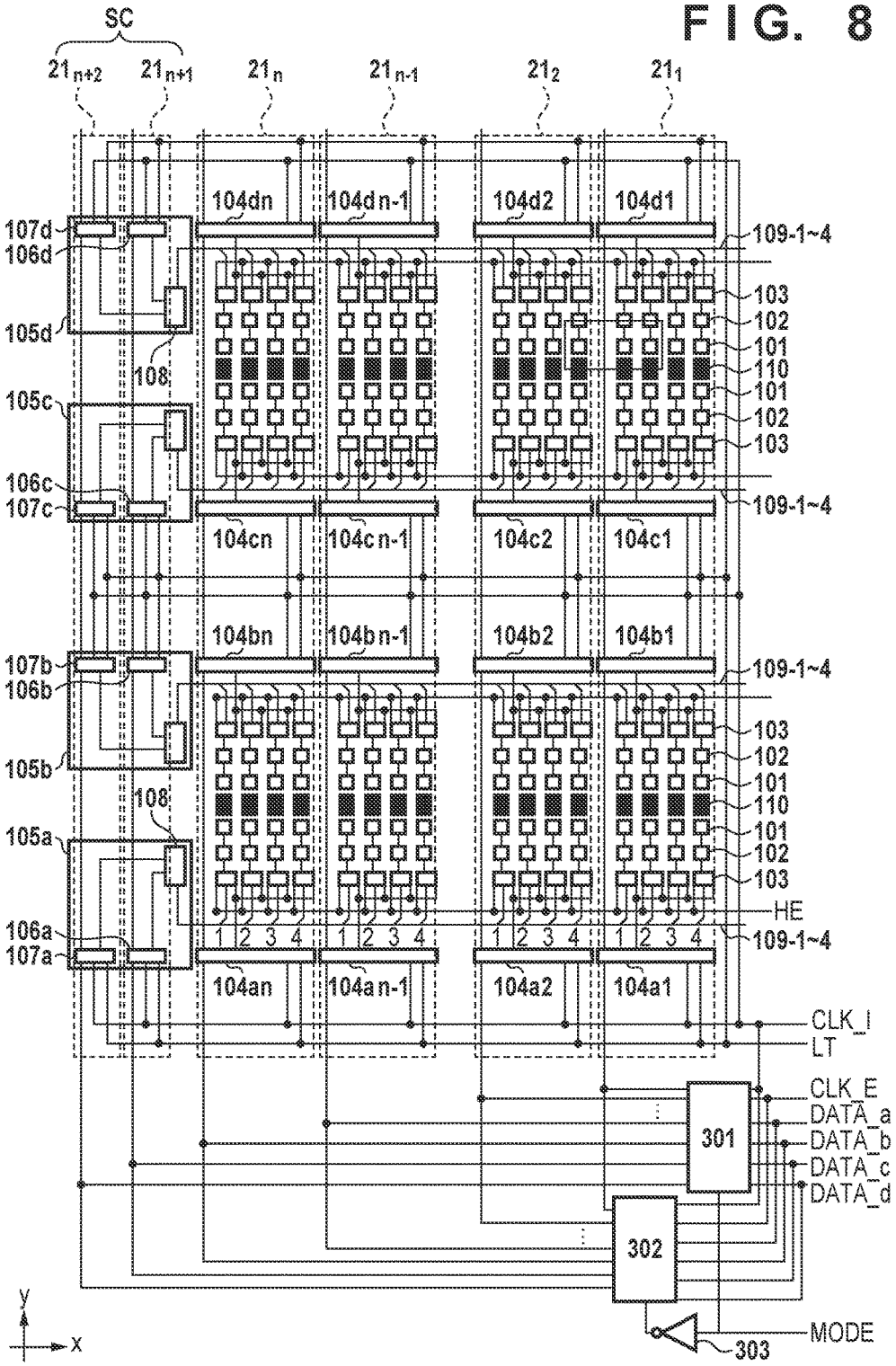
FIG. 8 is a circuit diagram showing the arrangement of an ink discharge apparatus according to the third embodiment of the present invention.

FIG. 8 shows an ink discharge component according to the third embodiment. The third embodiment provides the arrangement of the ink discharge component advantageous for downsizing a substrate S. If the number (that is, the value n) of blocks in each column unit increases, the bit width (n+2) of data to be supplied to shift registers $21_1$ to $21_{n+2}$ also increases. If input pads are provided on the substrate S for this bit width, the area of the substrate S may be increased for these input pads.

The ink discharge component according to the third embodiment is different from the first and second embodiments in that the ink discharge component includes data rearrangement circuits 301 and 302 and an inverter circuit 303. Matters not particularly mentioned in the third embodiment can comply with the first or second embodiment. The data rearrangement circuits 301 and 302 convert data having a bit width corresponding to the number of stages of each of the shift registers $21_1$ to $21_{n+2}$ into data having a bit width corresponding to the number of shift registers $21_1$ to $21_{n+2}$. The converted data are supplied from the data rearrangement circuits 301 and 302 to the shift registers $21_1$ to $21_{n+2}$.

A clock signal CLK_I is supplied to the shift registers $21_1$ to $21_{n+2}$. The clock signal CLK_I, a clock signal CLK_E, a selection signal MODE, and data DATA_a to DATA_d are supplied to the data rearrangement circuits 301 and 302. The data rearrangement circuits 301 and 302 rearrange data supplied as the data DATA_a to DATA_d, generating DATA1 to DATA(n+2). The selection signal MODE is supplied to the data rearrangement circuit 301 and the inverter circuit 303. An output from the inverter circuit 303 is supplied to the data rearrangement circuit 302. The data rearrangement circuits 301 and 302 are circuits having two operation modes, and can select one of the two operation modes in accordance with the selection signal MODE.

Figure 9:
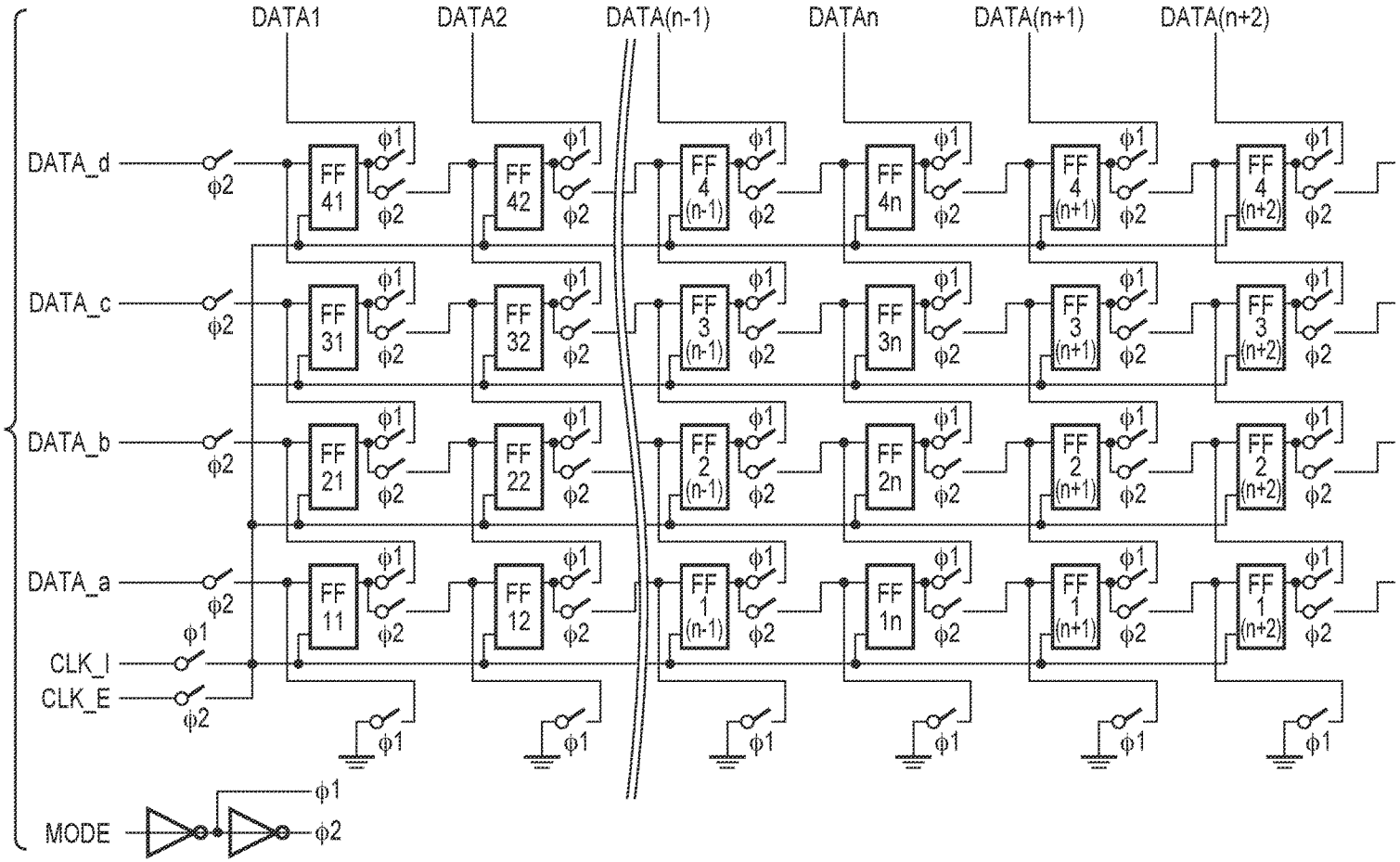
FIG. 9 is a circuit diagram showing an example of the arrangement of a data rearrangement circuit.

The data rearrangement circuits 301 and 302 can have the same arrangement. FIG. 9 exemplifies the arrangement of the data rearrangement circuits 301 and 302. In this arrangement example, each of the data rearrangement circuits 301 and 302 includes 4×(n+2) D flip-flops $FF_{pq}$ (p and q are integers satisfying $1 \le p \le 4$ and $1 \le q \le n+2$). The adjacent D flip-flops are connected by switches, and the connection is changed based on the logic of the selection signal MODE. ϕ1 added to the switch in FIG. 9 represents that the switch is ON when ϕ1 is at high level. ϕ2 added to the switch in FIG. 9 represents that the switch is ON when ϕ2 is at high level.

When the ϕ2-added switches are ON, the D flip-flops $FF_{pq}$ operate in response to the clock signal CLK_E. The D input terminals of the D flip-flops $FF_{pq}$ ($1<q \le n+2$) are connected to the Q output terminals of the D flip-flops $FF_{p(q-1)}$. The data DATA_a, DATA_b, DATA_c, and DATA_d are supplied to the D input terminals of the D flip-flops $FF_{p1}$. When the ϕ2-added switches are ON, the data rearrangement circuits 301 and 302 serially transfer the data DATA_a, DATA_b, DATA_c, and DATA_d corresponding to image data into $FF_{1q}$ and hold them in response to the clock signal CLK_E.

When the ϕ1-added switches are ON, the D flip-flops $FF_{pq}$ operate in response to the clock signal CLK_I. The D input terminals of the D flip-flops $FF_{pq}$ ($2<p \le 4$) are connected to the Q output terminals of the D flip-flops $FF_{(p-1)q}$. A fourth voltage VSS is supplied to the D input terminals of the D flip-flops $FF_{1q}$ (that is, low level is supplied). When the ϕ1-added switches are ON, the data rearrangement circuits 301 and 302 supply data held in the 4×(n+2) D flip-flops $FF_{pq}$ to the shift registers $21_1$ to $21_{n+2}$ in response to the clock signal CLK_I.

Figure 10:
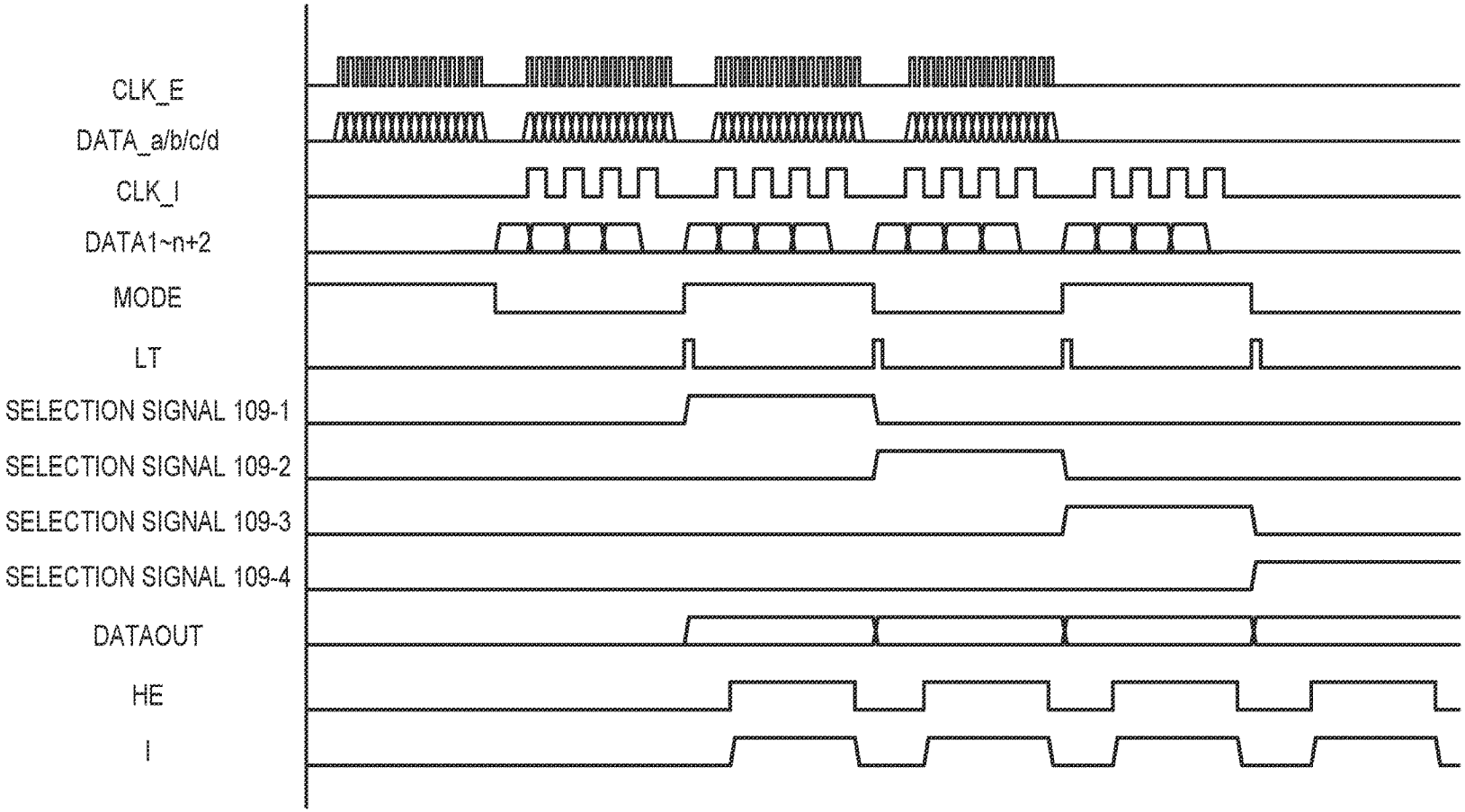
FIG. 10 is a timing chart showing the operation of the ink discharge apparatus according to the third embodiment of the present invention.

FIG. 10 shows the operation of the ink discharge component shown in FIGS. 8 and 9 according to the third embodiment. At first, the selection signal MODE is at high level, and the data rearrangement circuit 301 operates in response to CLK_E and receives data supplied as the data DATA_a, DATA_b, DATA_c, and DATA_d. This will be called the first operation. When the selection signal MODE changes to low level, the data rearrangement circuit 301 operates in response to the clock signal CLK_I and supplies the already held data to the shift registers $\mathbf{21}_1$ to $\mathbf{21}_{n+2}$. This will be called the second operation. After that, the data rearrangement circuit 301 repeats the first and second operations every time the logic of the selection signal MODE is switched. Since the selection signal MODE is input to the data rearrangement circuit 302 after its logic is inverted, the data rearrangement circuits 301 and 302 repeat the first and second operations while alternately swapping their roles. That is, an operation of receiving data by one of the data rearrangement circuits 301 and 302, and supplying data to the shift registers $\mathbf{21}_1$ to $\mathbf{21}_{n+2}$ from the other one is alternately repeated in every discharge period, successively supplying data to the shift registers $\mathbf{21}_1$ to $\mathbf{21}_{n+2}$.

According to the third embodiment, data having a bit width corresponding to the number of column units CU are rearranged into data having a bit width corresponding to the number of shift registers. The clock signal CLK_I for driving the shift registers $\mathbf{21}_1$ to $\mathbf{21}_{n+2}$ can be lower in frequency than the clock signal CLK_E for rearranging data. While reducing the power consumption of the shift registers $\mathbf{21}_1$ to $\mathbf{21}_{n+2}$, an increase in the number of input pads can be suppressed.

In the third embodiment, image data are rearranged using the high-frequency clock signal CLK_E, and the shift registers $\mathbf{21}_1$ to $\mathbf{21}_{n+2}$ are operated using the low-frequency clock signal CLK_I. Even when image data need to be fed quickly in order to increase the discharge frequency, portions that operate at high frequency are range limited up to the data rearrangement circuits, and the remaining portions can operate at low frequency. Thus, an image formation failure caused by generation of a transfer error can be easily avoided in comparison with a case in which the entire ink discharge component is operated at high frequency. In the third embodiment, the power consumption increases owing to an increase in the number of shift registers in the entire chip. However, logic circuits arrayed along ink discharge orifices have the same arrangement as those in the first and second embodiments, so reduction of the power consumption at the time of data transfer can be expected.

When no selection circuit SC is arranged, the data rearrangement circuits 301 and 302 can be configured to convert data having a bit width corresponding to the number of stages of each of the shift registers $\mathbf{21}_1$ to $\mathbf{21}_n$ into data having a bit width corresponding to the number of shift registers $\mathbf{21}_1$ to $\mathbf{21}_n$.

The fourth embodiment according to the present invention provides a discharge apparatus or recording apparatus including the ink discharge component (liquid discharge component) described in each of the first to third embodiments. The discharge apparatus or recording apparatus can include, for example, a data supply unit that supplies data to the ink discharge component, in addition to the ink discharge component (liquid discharge component) described in each of the first to third embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a continuation of U.S. patent application Ser. No. 14/960,916, filed Dec. 7, 2015, and which claims the benefit of Japanese Patent Application No. 2014-254550, filed Dec. 16, 2014, which are hereby incorporated by reference herein in their entirety.

What is claimed is:

1. A liquid discharge component comprising:

a substrate; and a plurality of discharge units arrayed to form a plurality of columns each extending in a first direction and a plurality of rows each extending in a second direction, wherein each of the plurality of discharge units includes a discharge orifice, a liquid chamber communicating with the discharge orifice, a discharging element configured to discharge a liquid through the discharge orifice, and a driving circuit configured to drive the discharging element, the liquid discharge component further comprises a logic circuit configured to control the driving circuits of the plurality of discharge units, the number of the plurality of columns is smaller than the number of the plurality of rows, a plurality of supply ports are provided in the substrate, at least some of the plurality of supply ports are arrayed along one of the plurality of columns, and a data wiring connected to the logic circuit to transfer data to the driving circuits is arranged on the substrate and has a portion extending along the second direction through a position between two of the plurality of supply ports.

2. The component according to claim 1, wherein the plurality of supply ports are arrayed correspondingly to the plurality of columns and the plurality of rows.

3. The component according to claim 1, further comprising a power supply wiring provided on the substrate between two of the plurality of supply ports.

4. The component according to claim 3, wherein the data wiring is smaller in width than the power supply wiring.

5. The component according to claim 4, wherein the plurality of supply ports respectively communicate with the liquid chambers of the plurality of discharge units.

6. The component according to claim 5, wherein the logic circuit includes a plurality of shift registers configured to transfer, in the second direction, data to be supplied to the driving circuits of the plurality of discharge units, each shift register is configured to supply data to the discharge units of at least one row, each shift register includes a plurality of flip-flops arranged in the second direction in correspondence with the plurality of columns and connected in series, and each of the plurality of flip-flops supplies data to the driving circuit of the discharge unit that is included in the at least one row corresponding to the shift register including the flip-flop, and included in a column corresponding to the flip-flop.

7. The component according to claim 6, wherein a second supply port is provided in the substrate, the second supply port extending in the first direction, and the liquid chamber of each of the discharge units forming one column out of the plurality of discharge units communicates with the second supply port via one of the plurality supply ports.

8. The component according to claim 6, wherein each shift register is configured to supply data to discharge units of at least two rows, and the logic circuit further includes a selection circuit configured to select one row out of the at least two rows corresponding to each shift register.

9. The component according to claim 8, wherein the selection circuit includes shift registers.

10. The component according to claim 9, wherein the number of the plurality of columns is less than a sum of the number of shift registers and the number of shift registers included in the selection circuit.

11. The component according to claim 9, wherein a number obtained by subtracting an average value of the number of flip-flops included in each of the plurality of shift registers and the shift registers included in the selection circuit, from a maximum value of the number of flip-flops included in each of the plurality of shift registers and the shift registers included in the selection circuit is less than 1.

12. The component according to claim 9, wherein the plurality of shift registers and the shift registers included in the selection circuit are divided into a plurality of groups, and different clock signals are supplied to the plurality of groups.

13. The component according to claim 9, further comprising a data rearrangement circuit configured to convert data having a bit width corresponding to the number of stages of each of the plurality of shift registers and the shift registers included in the selection circuit into data having a bit width corresponding to the number of the plurality of shift registers and the shift registers included in the selection circuit, and supply the data to the plurality of shift registers.

14. The component according to claim 6, wherein a number obtained by subtracting an average value of the number of flip-flops included in each of the plurality of shift registers from a maximum value of the number of flip-flops included in each of the plurality of shift registers is less than 1.

15. The component according to claim 6, wherein the plurality of shift registers are divided into a plurality of groups, and different clock signals are supplied to the plurality of groups.

16. The component according to claim 6, further comprising a data rearrangement circuit configured to convert data having a bit width corresponding to the number of stages of each of the plurality of shift registers into data having a bit width corresponding to the number of the plurality of shift registers, and supply the data to the plurality of shift registers.

17. A liquid discharge apparatus comprising a liquid discharge component, and a controller configured to control the liquid discharge component, the liquid discharge component including a substrate, and a plurality of discharge units arrayed to form a plurality of columns each extending in a first direction and a plurality of rows each extending in a second direction, wherein each of the plurality of discharge units includes a discharge orifice, a liquid chamber communicating with the discharge orifice, a discharging element configured to discharge a liquid through the discharge orifice, and a driving circuit configured to drive the discharging element, the liquid discharge component further including a logic circuit configured to control the driving circuits of the plurality of discharge units, the number of the plurality of columns is less than the number of the plurality of rows, a plurality of supply ports are provided in the substrate, at least some of the plurality of supply ports are arrayed along one of the plurality of columns, and a wiring connected to the logic circuit to transfer data to the driving circuits is arranged on the substrate and has a portion extending along the second direction from a position between two of the plurality of supply ports.

* * * * *